US007740455B1

(12) United States Patent
Nissen

(10) Patent No.: US 7,740,455 B1
(45) Date of Patent: Jun. 22, 2010

(54) PUMPING SYSTEM WITH HYDRAULIC PUMP

(76) Inventor: Brian Nissen, 19126 SW. Longfellow Ave., Lake Oswego, OR (US) 97035

( * ) Notice: Subject to any disclaimer, the term of this patent is extended or adjusted under 35 U.S.C. 154(b) by 183 days.

(21) Appl. No.: 11/825,700

(22) Filed: Jul. 9, 2007

(51) Int. Cl.
*F04B 35/02* (2006.01)

(52) U.S. Cl. ..... 417/225; 417/329; 417/397; 417/403

(58) Field of Classification Search ..... 417/53, 417/397, 403, 534, 535, 313, 329, 225, 227, 417/327, 334, 390, 393, 401
See application file for complete search history.

(56) References Cited

U.S. PATENT DOCUMENTS

| | | | | | |
|---|---|---|---|---|---|
| 24,838 | A | | 7/1859 | Worthington | |
| 77,214 | A | | 4/1868 | Ransom | |
| 157,617 | A | | 12/1874 | Loretz | |
| 525,731 | A | | 9/1894 | Walther | |
| 742,588 | A | | 10/1903 | Case | |
| 899,541 | A | | 9/1908 | Kirkwood | |
| 1,377,585 | A | | 5/1921 | Johanson | |
| 2,592,940 | A | | 4/1952 | Monoyer | |
| 3,086,470 | A | | 4/1963 | Skipor et al. | |
| 3,133,503 | A | | 5/1964 | Sheler | |
| 3,779,671 | A | * | 12/1973 | Lybecker et al. | 417/393 |
| 3,809,502 | A | | 5/1974 | Henry | |
| 4,019,838 | A | * | 4/1977 | Fluck | 417/393 |
| 4,123,204 | A | | 10/1978 | Scholle | |
| 4,514,149 | A | * | 4/1985 | Kanebako et al. | 417/403 |
| 4,620,836 | A | * | 11/1986 | Brandl | 417/364 |
| 4,627,794 | A | | 12/1986 | Silva | |
| 4,653,986 | A | * | 3/1987 | Ashton | 417/243 |
| 4,730,991 | A | * | 3/1988 | Handfield | 417/397 |
| 4,756,674 | A | * | 7/1988 | Miller | 417/534 |
| 4,844,700 | A | | 7/1989 | Henderson | |
| 4,895,492 | A | | 1/1990 | Bittel et al. | |
| 5,011,383 | A | * | 4/1991 | Bennitt | 417/534 |
| 5,451,145 | A | | 9/1995 | Sauter | |
| 5,462,414 | A | | 10/1995 | Permar | |
| 5,564,912 | A | | 10/1996 | Peck et al. | |
| 5,683,230 | A | * | 11/1997 | Karppinen | 417/397 |
| 6,062,828 | A | * | 5/2000 | Townsend | 417/397 |

(Continued)

FOREIGN PATENT DOCUMENTS

| | | |
|---|---|---|
| FR | 2603348 | 3/1988 |

(Continued)

*Primary Examiner*—Charles G Freay
(74) *Attorney, Agent, or Firm*—Simpson & Simpson, PLLC

(57) ABSTRACT

A system for pumping liquid having a first reservoir at a first elevation, which stores a first liquid, a second reservoir at a second elevation, where the second elevation is substantially lower than the first elevation, the second reservoir stores a second liquid, a third reservoir at a third elevation, where the third elevation is substantially lower than the first elevation, the second elevation is higher than the third elevation, the third reservoir arranged to store the second liquid, and, at least one hydraulic pump connected to the first reservoir via a first conduit, connected to the second reservoir via a second conduit, connected to the third reservoir via a third conduit, the pump arranged to be powered by the first liquid when the first liquid is permitted to fall due to gravity, the pump arranged to pump the second liquid from the third reservoir to the second reservoir.

14 Claims, 17 Drawing Sheets

U.S. PATENT DOCUMENTS

| | | | | |
|---|---|---|---|---|
| 6,079,959 | A | 6/2000 | Kingsford et al. | |
| 6,435,843 | B1 * | 8/2002 | Hur | 417/393 |
| 6,447,259 | B2 | 9/2002 | Elliott-Moore | |
| 6,478,552 | B1 * | 11/2002 | Batten et al. | 417/393 |
| 6,491,813 | B2 * | 12/2002 | Verde | 210/137 |
| 6,604,914 | B2 * | 8/2003 | Pares Criville | 417/313 |
| 6,729,860 | B1 | 5/2004 | Markham et al. | |
| 6,739,999 | B2 * | 5/2004 | Medico | 475/136 |
| 6,769,884 | B2 | 8/2004 | Miller | |
| 6,866,066 | B2 | 3/2005 | Weber | |
| 7,042,112 | B2 | 5/2006 | Wood | |
| 7,134,283 | B2 | 11/2006 | Villalobos | |
| 7,178,592 | B2 * | 2/2007 | Chitty et al. | 166/267 |
| 7,284,961 | B2 * | 10/2007 | Jacobsen | 417/53 |
| 2002/0085921 | A1 * | 7/2002 | Gram et al. | 417/53 |
| 2003/0185688 | A1 * | 10/2003 | Han | 417/329 |
| 2005/0095147 | A1 | 5/2005 | Silva | |
| 2005/0123416 | A1 | 6/2005 | Smith | |
| 2005/0194225 | A1 * | 9/2005 | Antonovsky | 188/280 |
| 2006/0013699 | A1 | 1/2006 | Lin et al. | |
| 2006/0216163 | A1 | 9/2006 | Park | |
| 2006/0267346 | A1 | 11/2006 | Chen | |
| 2007/0128053 | A1 * | 6/2007 | Stamper | 417/397 |
| 2008/0267786 | A1 * | 10/2008 | Springett et al. | 417/53 |

FOREIGN PATENT DOCUMENTS

| | | |
|---|---|---|
| JP | 58150078 | 9/1983 |
| JP | 60209676 | 10/1985 |
| JP | 2005248704 | 9/2005 |
| WO | WO 9315317 A1 * | 8/1993 |
| WO | WO 94/21915 | 9/1994 |

* cited by examiner

PUMPING SYSTEM WITH HYDRAULIC PUMP

FIELD OF THE INVENTION

The invention broadly relates to water pumping systems, more specifically to systems for hydraulically pumping water without the use of electricity.

BACKGROUND OF THE INVENTION

Finding and delivering clean drinking water is a challenge faced by many cities. Conventional methods to pump water from one place to another require electricity to run pumps, and power lines to get electricity to the pumping station. There are many losses between the initial generation of the electricity, the transfer of the electricity over power lines, and the mechanical inefficiency of the equipment to finally pump the water. These conventional methods have not developed an efficient pump that would convert a high-pressure primary fluid at low flow, into a low-pressure secondary fluid at high flow. In other words, there are currently no pumping systems which act as flow intensifiers. Since mountain reservoirs form naturally due to precipitation and melting cycles, there exists an untapped source of energy to power such a pump.

A number of patents relate to direct-acting reciprocating pumps, which transfer energy from one fluid to another using a piston or ram. Examples include U.S. Pat. No. 6,604,914 (Pares Criville); U.S. Pat. No. 5,462,414 (Permar); and U.S. Pat. No. 157,617 (Loretz). However, these pumps are designed to intensify the pressure of the output liquid, not to intensify the volumetric flow. Also, these pumps do not include an efficient internal stroke reversing system, but instead rely on an external mechanism triggered by high-pressure fluid. This high-pressure fluid is later dumped and not used for pumping, which wastes fluid and lowers efficiency. Lastly, these pumps submit their piston rods to compression, which limits their stroke lengths.

Thus, it can be seen that there is a long felt need for an efficient water pump which can operate without the use the use of electricity. Furthermore, there is also a need to expand the use of renewable energy sources.

BRIEF SUMMARY OF THE INVENTION

The present invention broadly comprises a system for hydraulically pumping liquid without using electricity having a first reservoir at a first elevation, operatively arranged to store a first liquid, a second reservoir at a second elevation, where the second elevation is substantially lower than the first elevation, the second reservoir operatively arranged to store a second liquid, a third reservoir at a third elevation, where the third elevation is substantially lower than the first elevation, and the second elevation is higher than the third elevation, the third reservoir operatively arranged to store the second liquid, and, at least one hydraulic pump connected to the first reservoir via a first conduit, connected to the second reservoir via a second conduit, connected to the third reservoir via a third conduit, the pump operatively arranged to be powered by the first liquid when the first liquid is permitted to fall due to gravity, the pump operatively arranged to pump the second liquid from the third reservoir to the second reservoir.

Preferably, the hydraulic pumping system includes a water tower which draws water from the first reservoir and delivers it to the second reservoir via the first conduit. The water from the first reservoir drives the hydraulic pump to pump water from the third reservoir to the second reservoir. Water stored in the second reservoir can then be passed through a turbine or a filter as it flows back into the third reservoir thereby generating electrical power or cleaning the water. Water can be drawn from either the second or third reservoirs as needed by the end user.

The system also preferably contains a sand trap to catch any larger debris contained in the water from the first reservoir. Water level monitors may also be put in all three of the reservoirs so that the level of each can be observed. Also, a water pressure surge protection means may be in place such as an accumulator or a pressure sensitive valve to maintain a substantially constant pressure of the water entering the hydraulic pump. Control valves may also be added to regulate the flow of water throughout the system.

In a preferred embodiment, the hydraulic pump generally comprises a cylindrical housing. The housing has a set of ports located near the middle of the pump for allowing a first liquid into and out of the pump. The cylindrical housing also has a second set of ports which are operatively arranged near both ends of the housing for allowing the flow of a second liquid into and out of the pump. The pump uses the pressure forces in the first liquid to power to pump the second liquid. In some embodiments the first liquid is discharged into the second liquid so that the hydraulic pump pumps a third liquid, which is a mixture of the first liquid and second liquid. Two pistons connected by a piston rod are housed within the cylindrical housing. Also, a spool valve is located in the housing between the pistons, through which the piston rod runs. The spool valve has a valve bumper on opposite sides of it, which the piston rod also runs though. Springs are secured to each piston to provide gradual impact of the pistons with the valve bumpers.

It is a general object of the present invention to provide a system to directly pump water from one location to another.

It is another object of the present invention to provide a system to use a small volumetric flow of high pressure water from a first reservoir to pump a large volumetric flow of low pressure water to where it is needed.

It is another object of the present invention to provide a system with the aforementioned functions that does not require electricity.

It is another object of the present invention to provide a system for pumping water which filters the water as it is pumped.

It is yet another object of the present invention to provide a water pumping system that can be used to generate electricity while it is pumping water.

It is yet another object of the present invention to utilize a naturally occurring renewable energy source.

These and other objects and advantages of the present invention will be readily appreciable from the following description of preferred embodiments of the invention and from the accompanying drawings and claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects. Also, the adjectives, "front," "back," "left," "right," "top," and "bottom" and their derivatives, in the description herebelow, refer to the perspective of one facing the invention as it is shown in the Figure under discussion.

Furthermore, it should be understood that this invention is not limited to the particular methodology, materials and modifications described and as such may, of course, vary. It should also be understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Words such as conduit, pipeline, and channel are generally synonymic throughout, and may be used interchangeably. These words are used to simply indicate a preferred method of carrying liquid, and do not necessarily have to be pipelines or channels. Although any methods, devices or materials similar or equivalent to those described herein can be used in the practice or testing of the invention, the preferred methods, devices, and materials are now described.

Structure

In a preferred embodiment there is a single reservoir at a first elevation, a single reservoir at a second elevation and a single reservoir at a third elevation. The first elevation is preferably much greater than the second and third elevations, and the second elevation is greater than the third. This simulates a common scenario in cities where there are pumping stations dedicated to delivering water to remote tanks at relatively high elevations within the region. Also, it demonstrates the scenario where water may be drawn from the sea (represented by the third reservoir), and must be pumped to a city (represented by the second reservoir) located at a higher elevation. In these and a myriad of other similar situations, water can be drawn from lower areas and pumped to higher elevations without the reliance on electricity.

Figure 1:
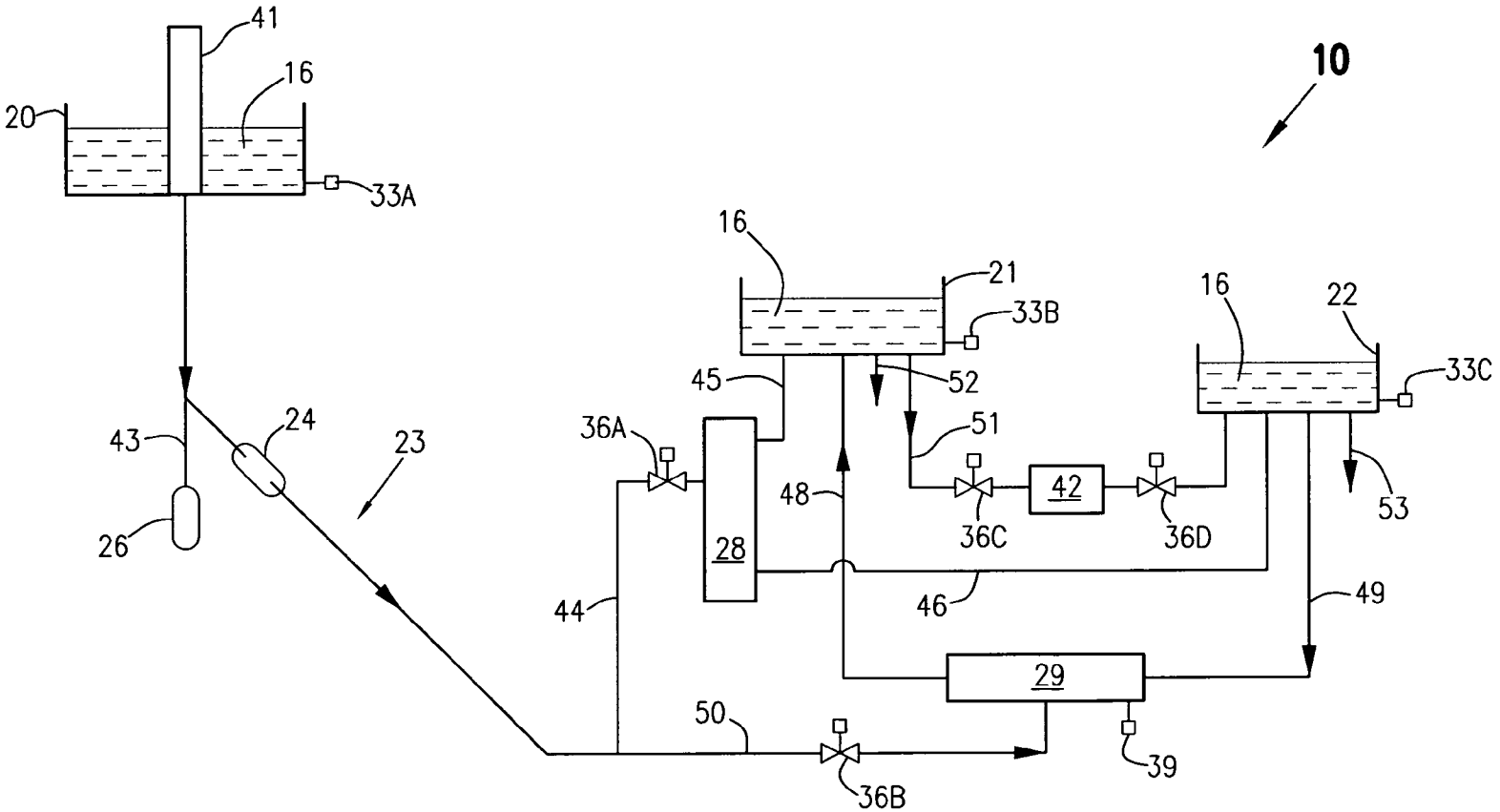
FIG. 1 is a schematic of hydraulic pumping system 10 which utilizes a water filter to clean the pumped water.

Adverting now to the drawings, FIG. 1 shows a schematic of a preferred embodiment of the hydraulic pumping system 10 with first reservoir 20 containing water level sensor 33A and intake tower 41. Intake tower 41 is preferably cylindrical in shape and has a foundation on the bottom of first reservoir 20. First conduit 23 is attached to intake tower 41 and carries the water away from the first reservoir to high pressure conduit 50 and eventually hydraulic pump 29, as indicated by the direction in which the arrows point along the line representing conduit 23. Conduit 23 is preferably a heavy duty water transfer line. Conduit 23 may include at least one slip joint 24 along its length to prevent damage in the event of expansion or movement. The hydraulic pumping system may also include sand trap 26 connected to conduit 23 by pipeline 43.

It should be appreciated that conduit 23 can be made of a single large diameter pipeline or several smaller pipelines running in parallel. Using multiple smaller diameter pipelines may be an effective way to keep water flowing if conduit 23 is in need of repair.

Preferably, second reservoir 21 contains water level sensor 33B and third reservoir 22 contains water level sensor 33C. Second reservoir 21 and third reservoir 22 are preferably, but not necessarily, located near a city. There is a significant difference in elevation and possibly distance between first reservoir 20 and reservoirs 21 and 22. Second reservoir 21 is connected to third reservoir 22 through conduit 51. A plurality of control valves 36A, 36B, 36C, 36D, 36E, 36F are preferably included throughout the piping system to regulate flows, and to allow operators to seal off specific portions of the system in case of repair. The control valves could be manually operated, or remotely controlled from a control station. Static pressure sensor 39 is preferably attached to hydraulic pump 29 to monitor pressure changes in the pump.

Figure 2:
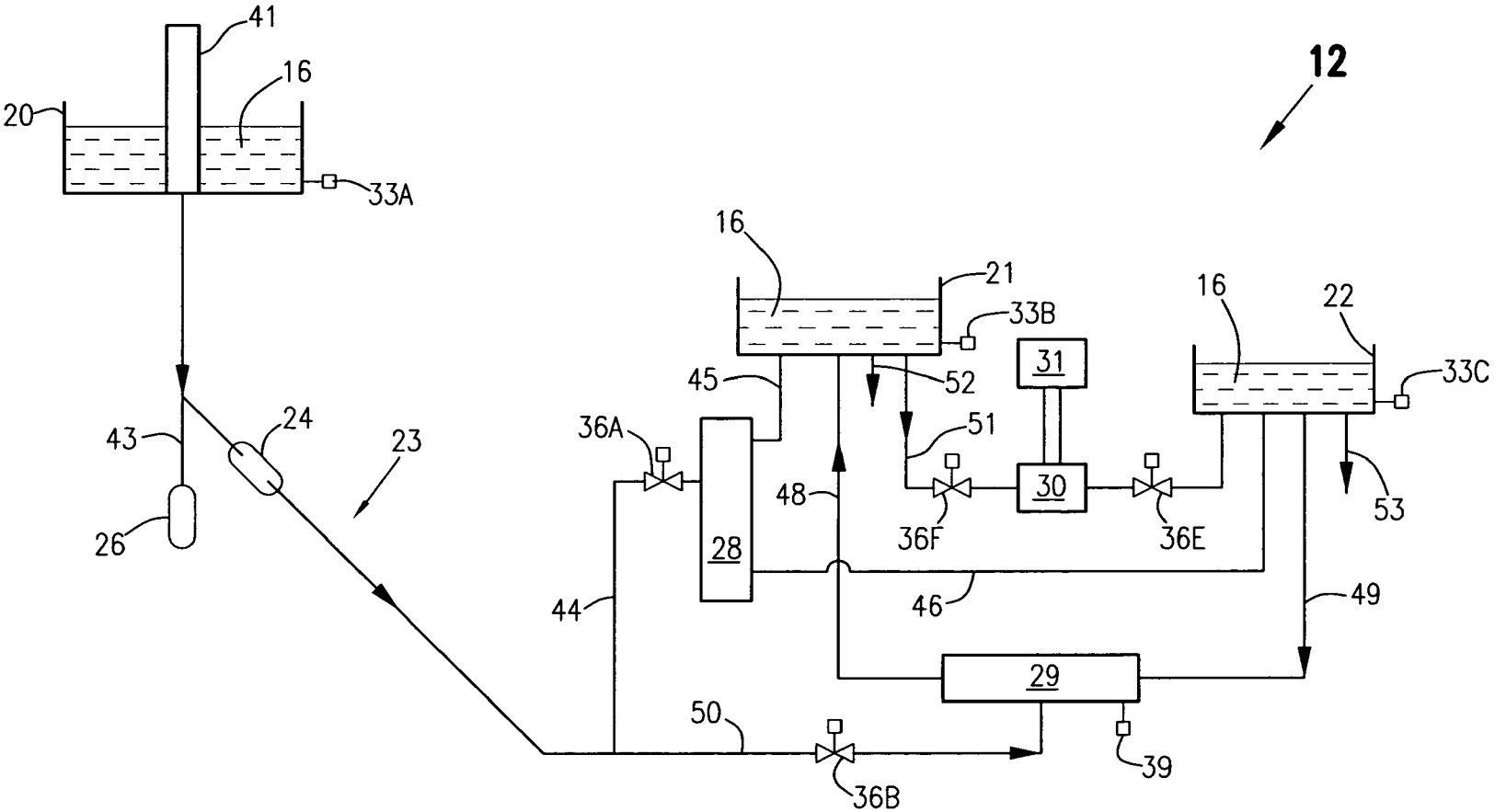
FIG. 2 is a schematic hydraulic pumping system 12 which includes a turbine for generating electricity.
Figure 3:
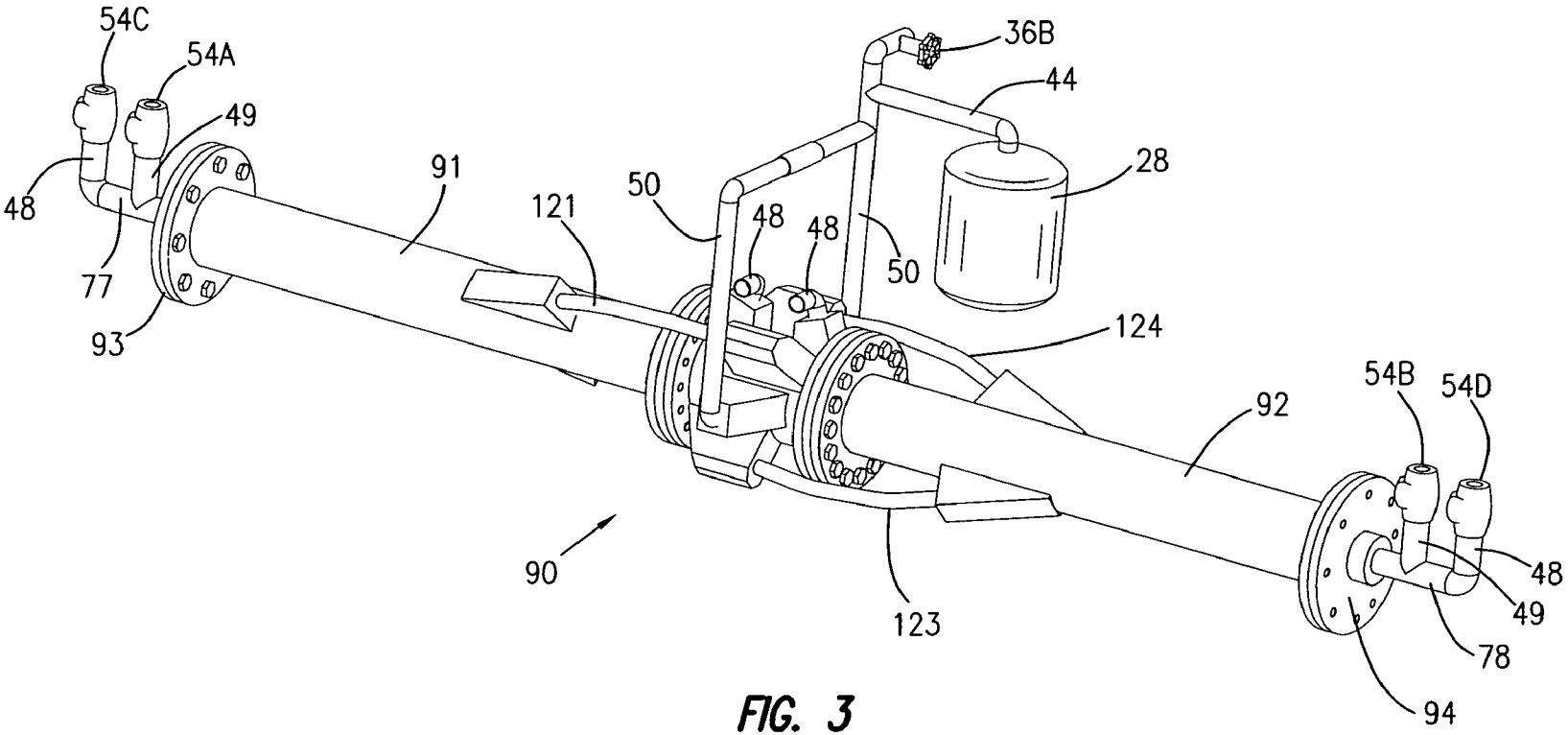
FIG. 3 is a perspective view of hydraulic pump 29 with surrounding trim piping and components.

In one embodiment, shown in FIG. 1, generally referred to as hydraulic pumping system 10, water filter 42 is connected to conduit 51. In another embodiment, illustrated in FIG. 2, generally referred to as hydraulic pumping system 12, water turbine 30 and control valves 36E and 36F are located on conduit 51. Water turbine 30 drives generator 31. Low pressure conduit 49 delivers low pressure water to hydraulic pump 29. Hydraulic pump 29 delivers water through outlet conduit 48 to second reservoir 21. Pressure surge protection means 28 is pressure sensitive and draws water through surge protection pipeline 44 if pressures fluctuate for protecting hydraulic pump 29 and first conduit 23 from damaging pressure surges. Pressure surge protection means 28 could be a pressure sensitive valve, an accumulator, or any other device which can maintain a substantially constant water pressure. Surge protection means 28 may be connected to reservoirs 21 and 22 by pipelines 45 and 46, respectively.

Figure 4:
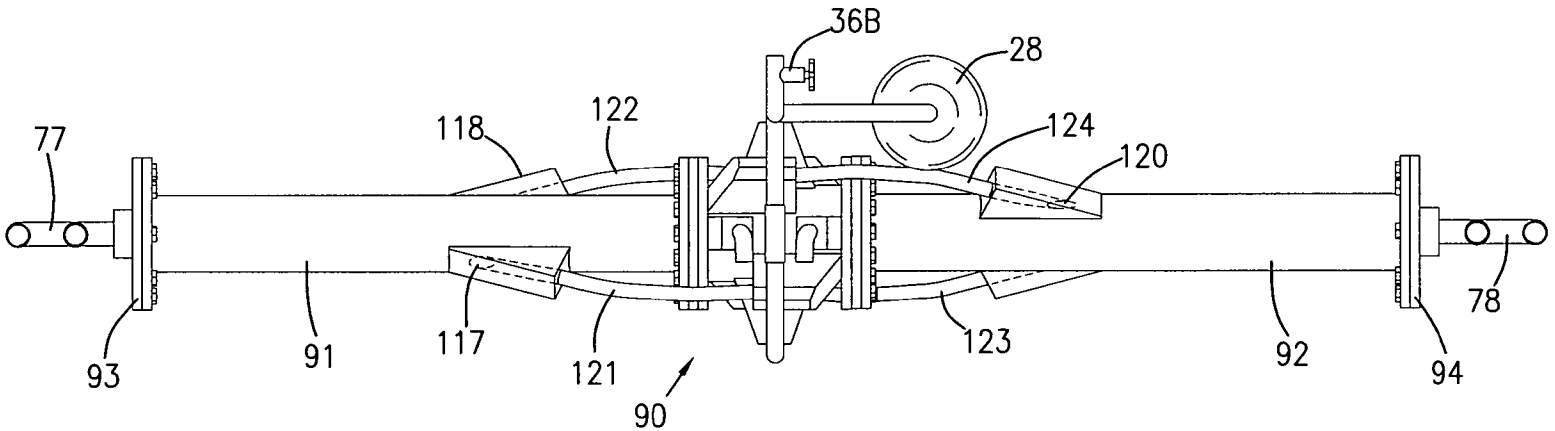
FIG. 4 is a top view of the hydraulic pump and surrounding trim, as seen in FIG. 3.
Figure 5:
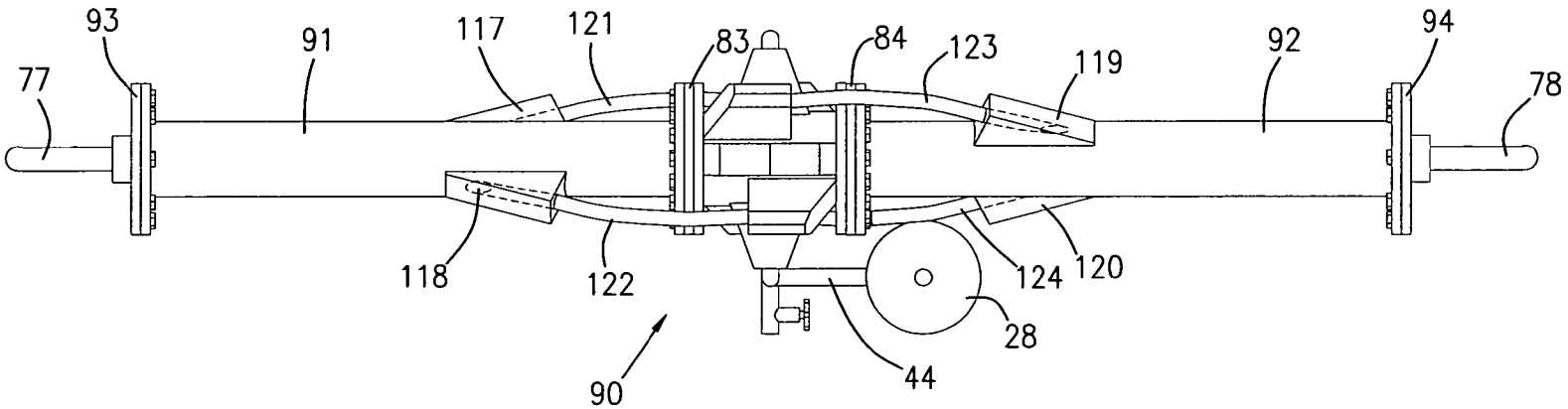
FIG. 5 is a bottom view of the hydraulic pump and surrounding trim.

FIGS. 3-7 show a perspective view, top view, bottom view, left side view, and right side view, respectively, of hydraulic pump 29 and surrounding piping and components. In the shown embodiment, surge protection means 28 is an expansion tank. Control valve 36B is a manual crank style shutoff valve. High pressure input lines 50 connect to valve housing 90. Right end pipeline 78 and left end pipeline 77 allow water from low pressure conduit 49 to enter hydraulic pump 29 and for water to exit the pump via outlet conduit 48. Check valves 54A, 54B, 54C, and 54D restrict the flow of water so that water can only flow into the hydraulic pump from pipeline 49 and out of the hydraulic pump through pipeline 48. FIGS. 4 and 5 show ports 117, 118, 119, and 120 in the left and right cylinders by the use of hidden lines.

The hydraulic pump is comprised of valve housing 90 which is located between left cylinder 91 and right cylinder 92. Left endplate 93 is attached to the outer end of cylinder 91, and left end port 125 (hidden from view) is centrally located in end plate 93. Right endplate 94 is attached to the outer end of right cylinder 92 and right end port 126 is centrally located in end plate 94. The end plates, cylinders and valve housing have circular cross-sections and are axially aligned. Transfer pipelines 121 and 122 allow high pressure water from valve housing 90 to be delivered into left cylinder 91. Transfer pipelines 123 and 124 allow high pressure water from valve housing 90 to be delivered into right cylinder 92.

Figure 8:
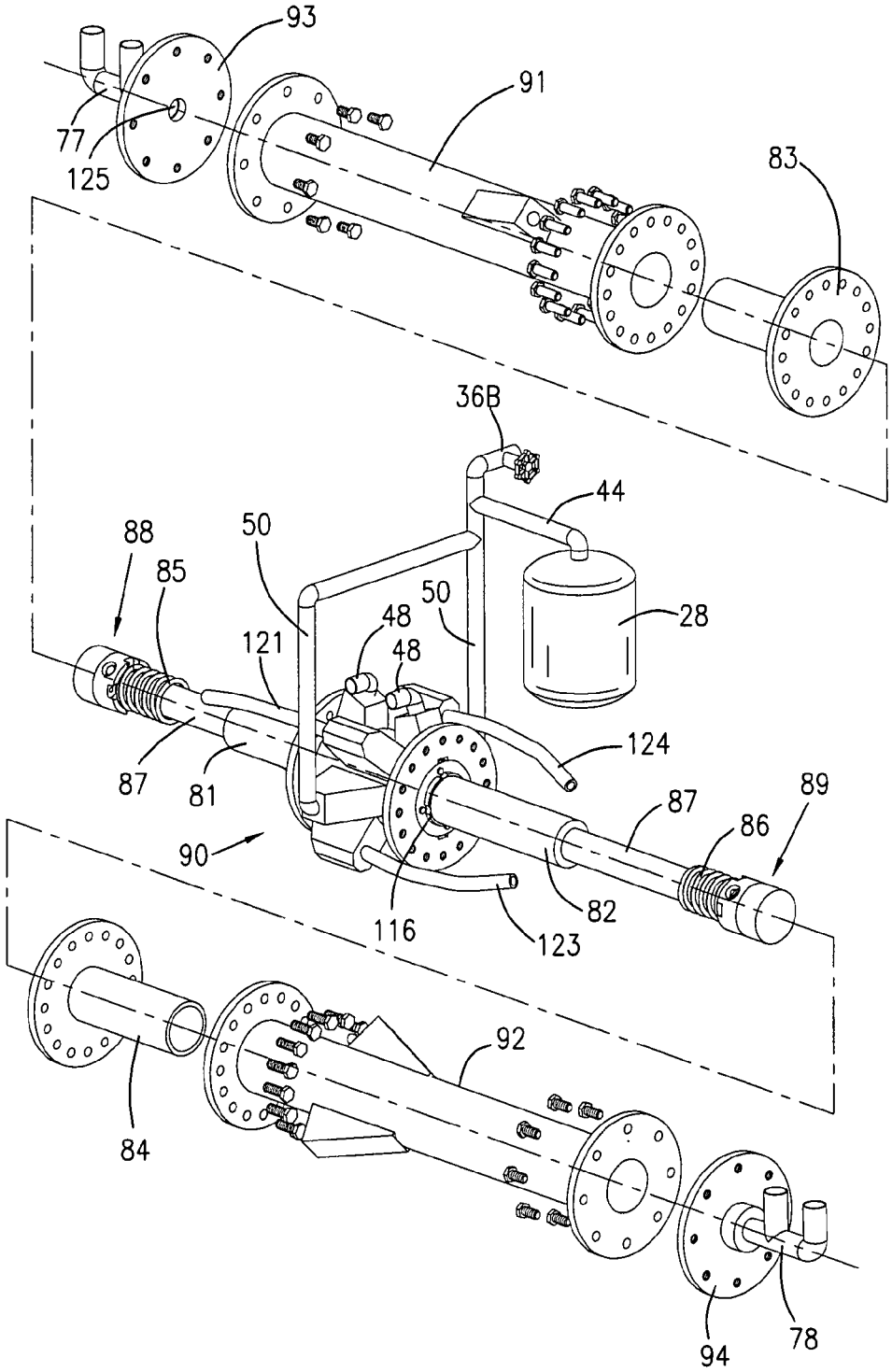
FIG. 8 is a perspective exploded view of hydraulic pump 29 with some trim piping and components.
Figure 9:
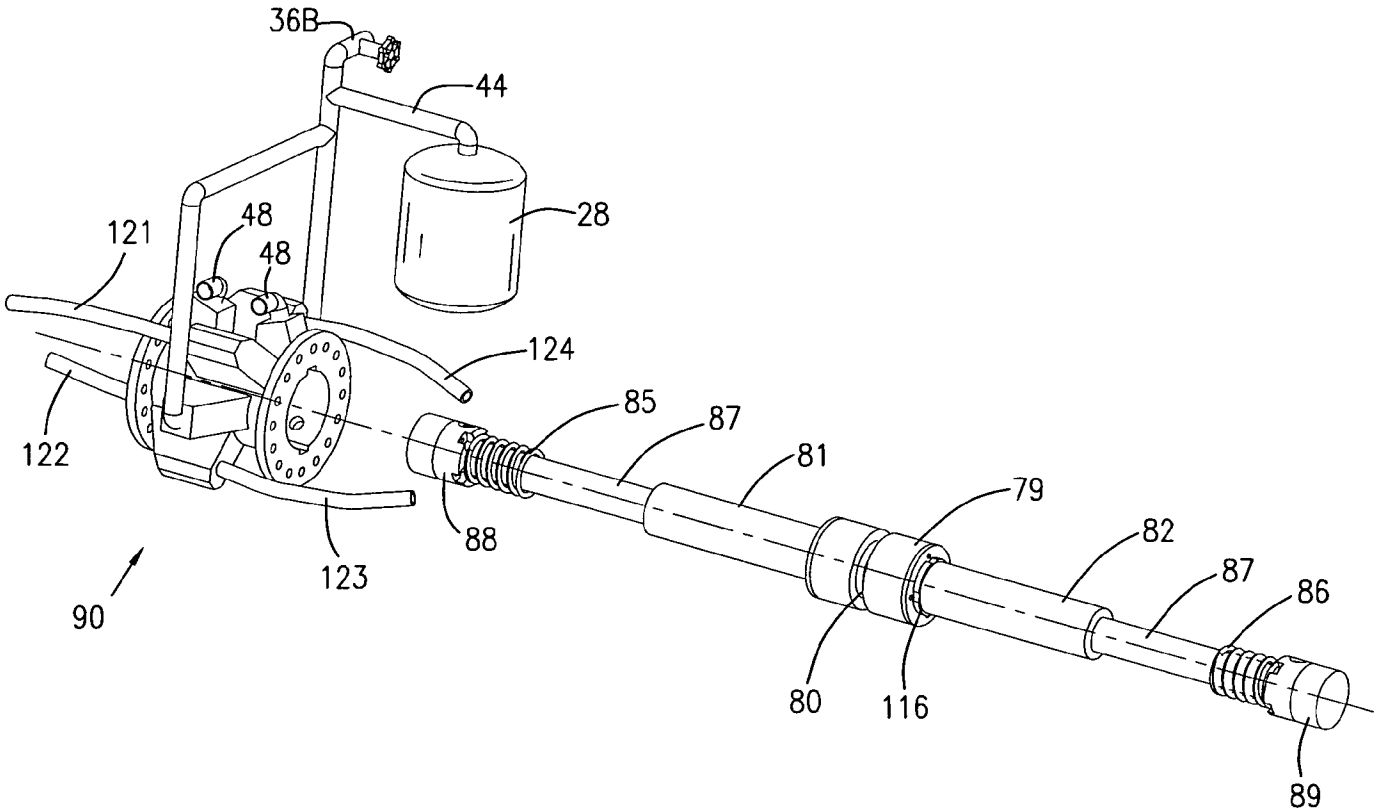
FIG. 9 is an exploded view of the moveable parts responsible for pumping the water in hydraulic pump 29.

FIGS. 8 and 9 show exploded views of hydraulic pump 29. Cylinder sleeve 83 fits tightly inside the inner end of cylinder 91. Cylinder sleeve 84 fits tightly inside the inner end of cylinder 92. Spool valve 79 is located between valve bumpers 81 and 82 and contains spool valve channel 80. Valve bumper 81 is slidably housed within cylinder sleeve 83. Valve bumper 82 is slidably housed within cylinder sleeve 84. The valve bumpers are preferably affixed to either side of spool valve 79. Spool valve 79 slides back and forth within the valve housing 90. Attached to left valve bumper 81 is left valve stopper 115. Attached to right valve bumper 82 is right valve stopper 116. Left cylinder 91 houses left piston 88 and right cylinder 92 houses right piston 89. Piston rod 87 connects pistons 88 and 89. Left compression spring 85 is located near left piston 88 and right compression spring 86 is located near right piston 89. Piston rod 87 axially passes through valve bumpers 81 and 82 as well as spool valve 79. Both corresponding members of the pairs of pistons 88 and 89, valve bumpers 81 and 82, and cylinders 91 and 92, are ideally the same size and shape.

Figure 6:
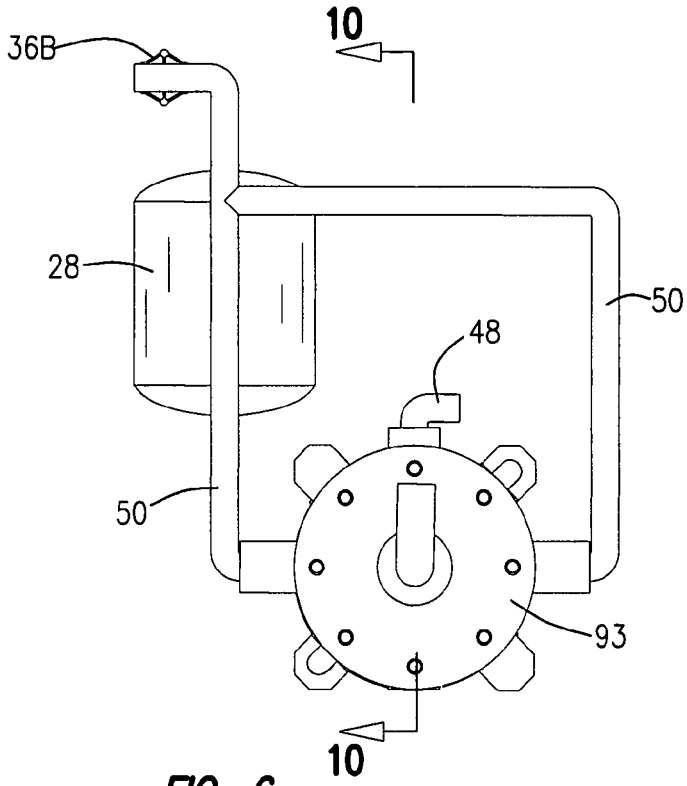
FIG. 6 is a view of the hydraulic pump and surrounding trim, as taken from the left side.
Figure 7:
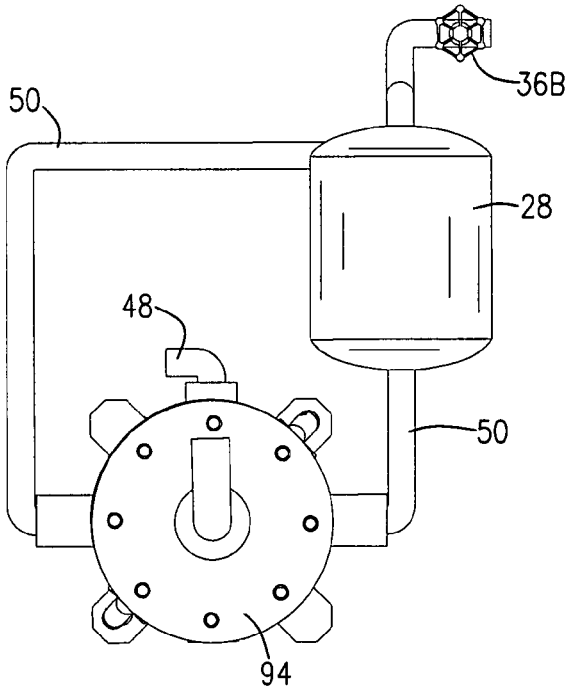
FIG. 7 is a view of the hydraulic pump and surrounding trim, as taken from the right side.
Figure 10:
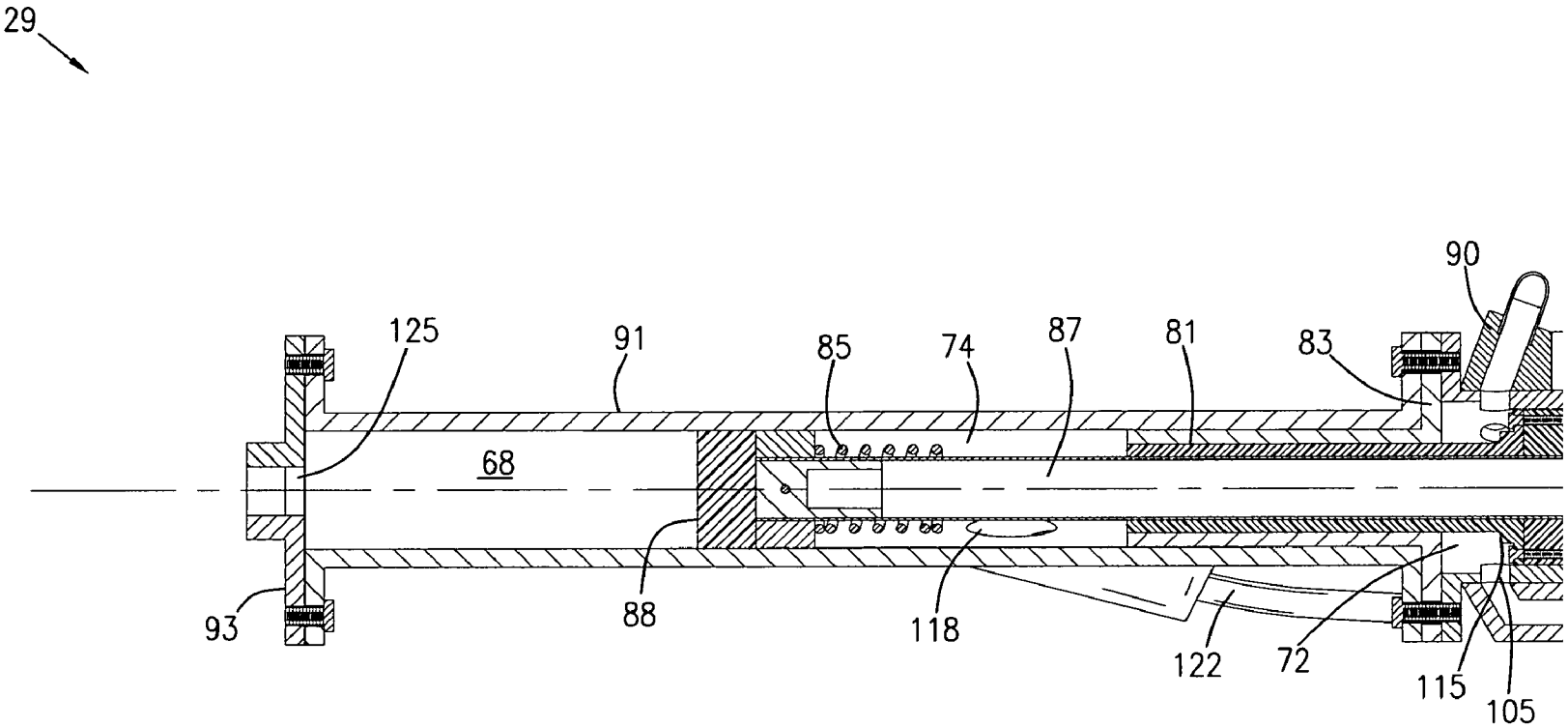
FIG. 10 is a section view of the hydraulic pump taken generally along line 10-10 in FIG. 6 showing the inside of the hydraulic pump, and it has been enlarged to span two pages.
Figure 10:
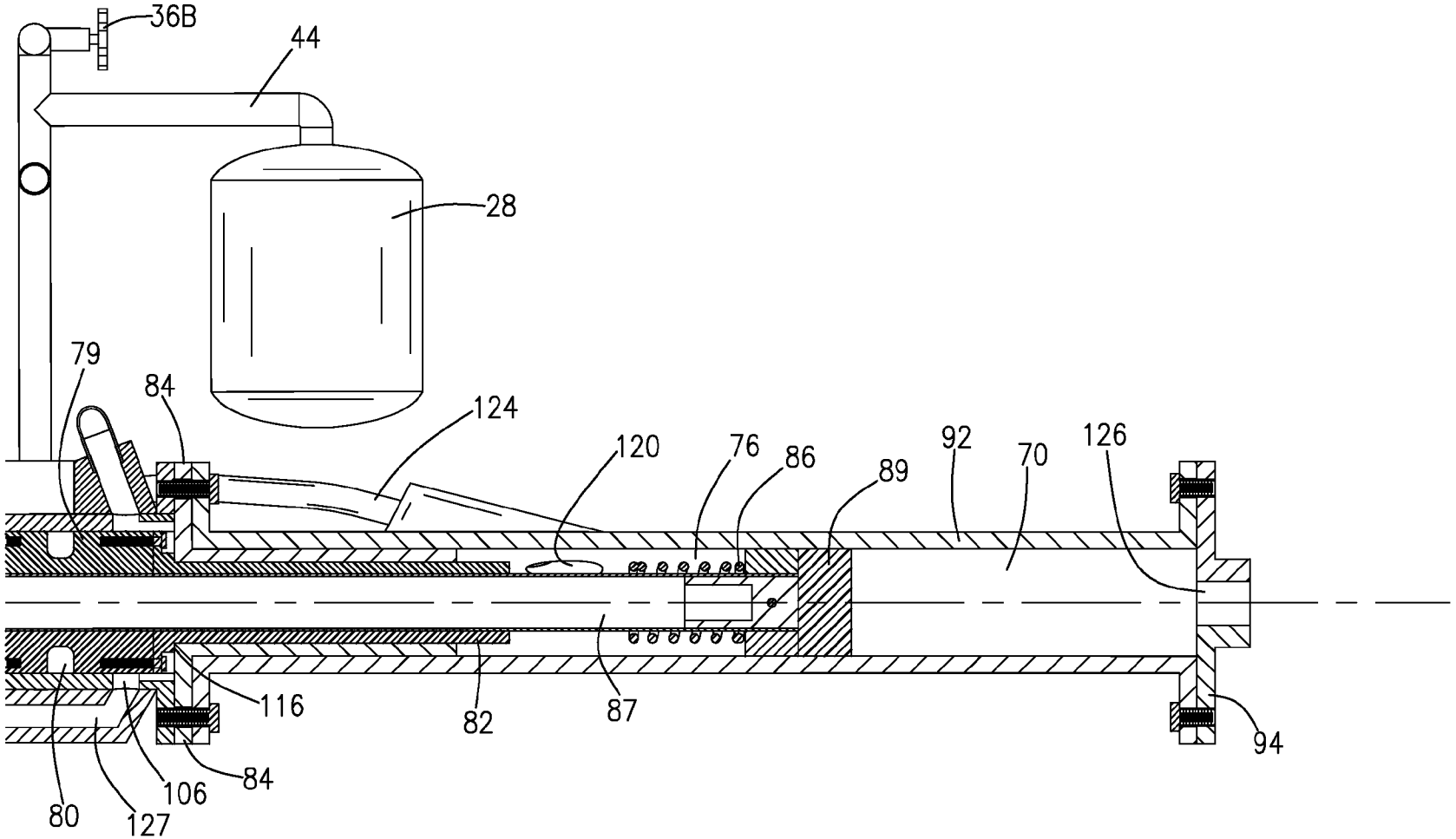

FIG. 10 shows a section view of the hydraulic pump 29 taken generally along the line 10-10 in FIG. 6. The area in left cylinder 91 between left piston 88 and left endplate 93 generally defines left end chamber 68. The area in left cylinder 91 between left piston 88 and left cylinder sleeve 83 generally defines left inner chamber 74. The area in right cylinder 92 between right piston 89 and right endplate 94 generally defines right end chamber 70. The area in right cylinder 92 between right piston 89 and right cylinder sleeve 84 generally defines right inner chamber 76. The area in cylinder 90 between left cylinder sleeve 83 and right cylinder sleeve 84 generally defines middle chamber 72.

Figure 11A:
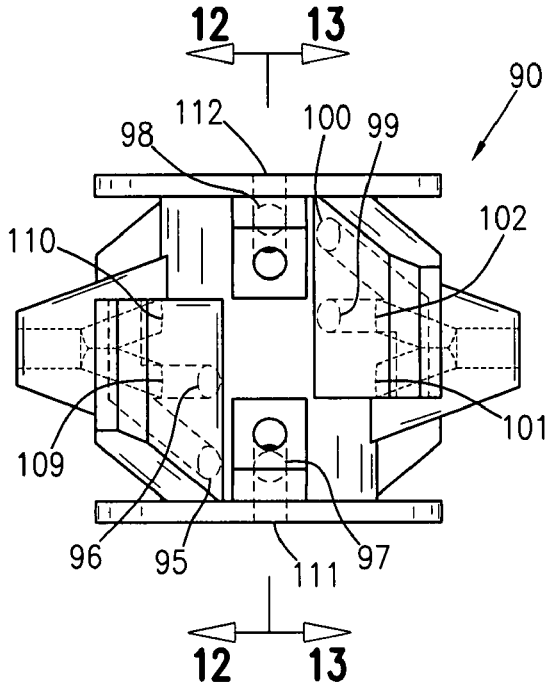
FIG. 11*a* is a plan view of valve housing 90 illustrating the interior porting of the valve housing hidden lines.
Figure 11B:
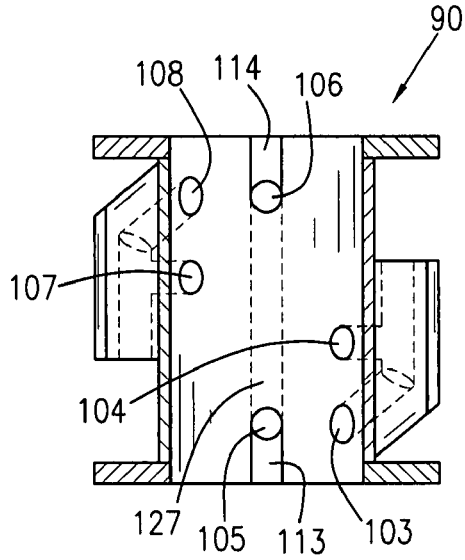
FIG. 11*b* is section view of valve housing 90 taken just below the half way point on the valve housing as shown in FIG. 11*a* so as to reveal the porting on the bottom portion of the valve housing.
Figure 12:
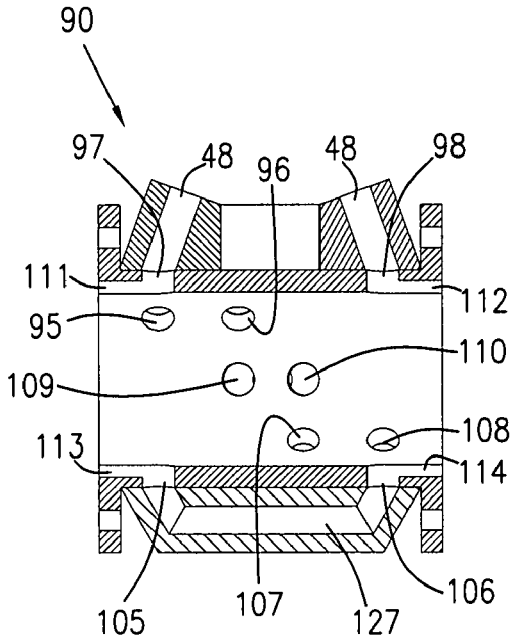
FIG. 12 is a section view of valve housing 90 taken generally along line 12-12 in FIG. 11*a* showing the inside of the valve housing.
Figure 13:
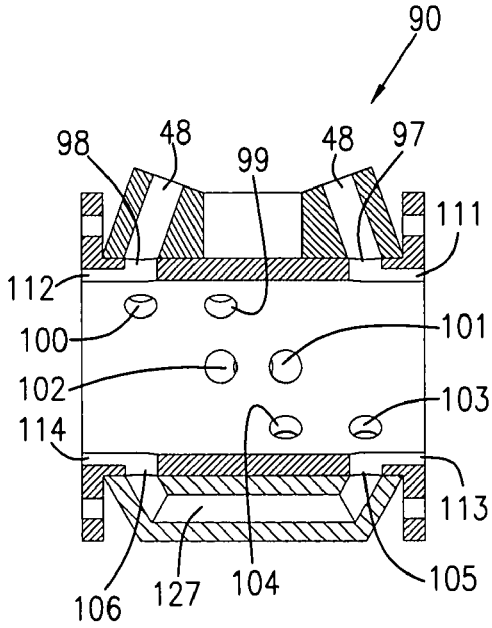
FIG. 13 is a section view of valve housing 90 taken generally along line 13-13 in FIG. 11*a* showing the inside of the valve housing.

FIGS. 11*a*, 11*b*, 12 and 13 illustrate the valve housing 90. FIG. 11*a* is a plan view of the valve housing with hidden lines representing the porting and channeling on top portion of the valve housing. FIG. 11*b* is a section view taken just below the halfway point on the valve housing in FIG. 11*a* to reveal the porting and channeling on the bottom portion of the valve housing. FIGS. 12 and 13 are views taken generally along lines 12-12 and 13-13, in FIG. 11*a*, respectively. FIGS. 12 and 13 reveal the front and back halves of valve housing 90. Valve housing 90 has ports 95, 96, 97, 98, 99, 100, 101, 102, 103, 104, 105, 106, 107, 108, 109, and 110 arranged through the walls of the valve housing. Ports 97, 98, 105, and 106 have channels 111, 112, 113, and 114, respectively.

The ports in valve housing 90 can be grouped into sets for ease of explanation. Each set has a specific function and each set is connected to a specific pipeline or conduit as summarized by Table 1. For example, examining Table 1, it can be seen that ports 99 and 100 are grouped together because they are both connected to pipeline 121 and therefore to left chamber 74. Table 1 also indicates that ports 107 and 108 are also connected to left chamber 74, but by pipeline 122. Therefore the group of ports 99 and 100, and the group of ports 107 and 108 perform substantially the same function (providing communication between the middle chamber 72 and the left chamber 74), but achieve it by using a different pipeline, as indicated in Table 1. The pairs of sets that perform the same function, as indicated by the left most column in Table 1, are located 180 degrees from each other on the valve housing 90.

TABLE 1

| Set Type/Function | Ports in Set | Pipeline/Conduit |
|---|---|---|
| Right Chamber 76 | 95, 96 | 124 |
| Low-pressure Outlet | 97, 98 | 48 |
| Left Chamber 74 | 99, 100 | 121 |
| High-Pressure Inlet | 101, 102 | 50 |
| Right Chamber 76 | 103, 104 | 123 |
| Low-pressure Free Flow in Valve Housing 90 | 105, 106 | 127 |
| Left Chamber 74 | 107, 108 | 122 |
| High-pressure Inlet | 109, 110 | 50 |

The hydraulic pump is preferably made of stainless steel because it has highly resistant properties and should not corrode or rust due to the lengthy submersion in water. Other highly resistant, durable materials may also work sufficiently. Most of the inner components are also preferably made of stainless steel or other resistant metal, with the exception of the pistons, valve bumpers, and the spool valve. Since these pieces are tightly housed and move within a stainless steel housing, it is not recommended to also make them out of metal, as moving pieces of similar metals will tend to bind to each other. Instead, a high durability, resistant plastic, such as PEEK (Polyetheretherketon), is preferred to avoid the binding that would occur between two similar metals. It should be apparent to one skilled in the art, however, that any range of materials could be used to sufficiently perform the tasks of the hydraulic pump. Also, the Figures show a plurality of bolts securing the affixed components together. Other fastening means may be used, such as rivets, welding, or the like. Alternatively, in some embodiments it may be preferred to make affixed parts out of a single piece, which would eliminate the need for screws or other fastening means.

It is recommended that at least one of the reservoirs 21 or 22 be at an elevation above the end consumers of the water to supply them with water at a suitable pressure by force of gravity. It is also preferred, if possible, that both reservoirs 21 and 22 should be concrete tanks located underground. This will allow the reservoirs 21 and 22 to be protected against contamination both accidental and intentional, and will free up land area for other uses. The reservoirs may also contain spillways (not shown) which would act as a failsafe to ensure that any particular reservoir does not overflow.

Operation

Referring back to FIGS. 1 and 2, it can be seen that in water pumping systems 10 and 12, water tower 41 collects water, denoted by numeral 16 and transfers it via first conduit 23 to high pressure conduit 50, which then delivers it to hydraulic pump 29. Sand trap 26 is preferably included to remove debris from the flow of water. Slip joints 24 may be included to allow the conduit some degree of movement in the event that it is shifted after it is put in place. Since the water from first reservoir 20 has undergone a large elevation drop, it has a high pressure at the elevation of hydraulic pump 29. This water pressure powers hydraulic pump 29 to draw in water from third reservoir 22 via conduit 49 and pump it into second reservoir 21 via outlet conduits 48.

The hydraulic pump essentially takes a relatively low volumetric flow of water with a high pressure (due to a large elevation drop) and converts it into a high volumetric flow of water with a low pressure. This can be verified by applying the laws of conservation of energy and matter; both energy and matter can be neither created nor destroyed. Very simply, assuming no losses, $Power_{in}=Power_{out}$. Also, $Power_{in}=Flow_{falling}*Fall$, where $Flow_{falling}$ is the volumetric flow of water into the pump from the first reservoir, and Fall is the elevation drop between the first reservoir and the second reservoir. Likewise, $Power_{in}=Flow_{rising}*Rise$, where $Flow_{rising}$ is the volumetric flow of water into the pump from the third reservoir (which is then pumped to the second reservoir), and Rise is the elevation difference between the second reservoir and the third reservoir. Therefore, $Flow_{falling}*Fall=Flow_{rising}*Rise$. It can then be clearly seen that in a scenario with a very large Fall and a relatively small Rise, that $Flow_{rising}$ will be much greater than $Flow_{falling}$. It is these principles that allow the hydraulic pump to act as a flow intensifier. The pump essentially converts a relatively low volumetric flow into a high volumetric flow. Obviously, losses will occur under actual conditions due to friction, but this will not be a problem if the first reservoir is located at a substantially higher elevation than the second and third reservoirs.

Water can be sent to the end user from either pipeline 52 in second reservoir 21 or pipeline 53 in third reservoir 22. Second reservoir 21 is connected to third reservoir 22 by conduit 51. Preferably water filter 42 is connected to conduit 51 to clean the water that travels from the second reservoir into the third reservoir. Water level sensors 33A, 33B, and 33C are preferably included to monitor the level of the water in each of the three reservoirs. Water pressure surge protection means 28 is also preferably included, and is connected to first conduit 23 via pipeline 44, the second reservoir via pipelines 45 and the third reservoir via pipeline 46. Turbine 30 and generator 31 may also be connected to conduit 51 to generate electricity by using the elevation difference of the water between the second and third reservoirs.

Vital to the operation of hydraulic pump 29 is the precise machining of the slidable pieces; piston rod 87 slides within valve bumpers 81 and 82 as well as spool valve 79, valve bumpers 81 and 82 slide within the cylinder sleeves 83 and 84, and spool valve 79 slides within valve housing 90. These pieces preferably have tolerances between them to prevent leakage, but to allow for a thin film of water to form on their surfaces for purpose of lubrication. In other words, in order to achieve free relative movement, running fits are preferred between the housing and all of the moveable pieces.

FIGS. 14-19 illustrate six general stages that the hydraulic pump goes through for each stroke. Since pistons 88 and 89, compression springs 85 and 86, and piston rod 87 are affixed as one moveable piece, the group of them together may hereafter be referred to as the "piston apparatus" for ease of discussion. Likewise, since spool valve 79, valve bumpers 81 and 82, and valve stoppers 115 and 116 are affixed as one moveable piece, the group of them together may hereafter be referred to as the "valve apparatus" for the sake of discussion. Please note that arrows have been superimposed over the moving parts and the pipelines, for illustration purposes only, to indicate the direction that the parts are moving and that the water is flowing, respectively. Also, in FIGS. 14-19 the porting in valve housing 90 has been simplified, as ports 95, 96, 97, 98, 107, 108, 109, 110, 118, and 120 are all shown in the same plane, which is not really the case. Refer back to FIGS. 11-13 to see the preferred porting in the valve housing. Also, since ports 99, 100, 101, 102, 103, 104, 105, 106, 117, and 119 are not shown, please refer to Table 1 to see the function of and corresponding conduits for these ports.

Figure 14:
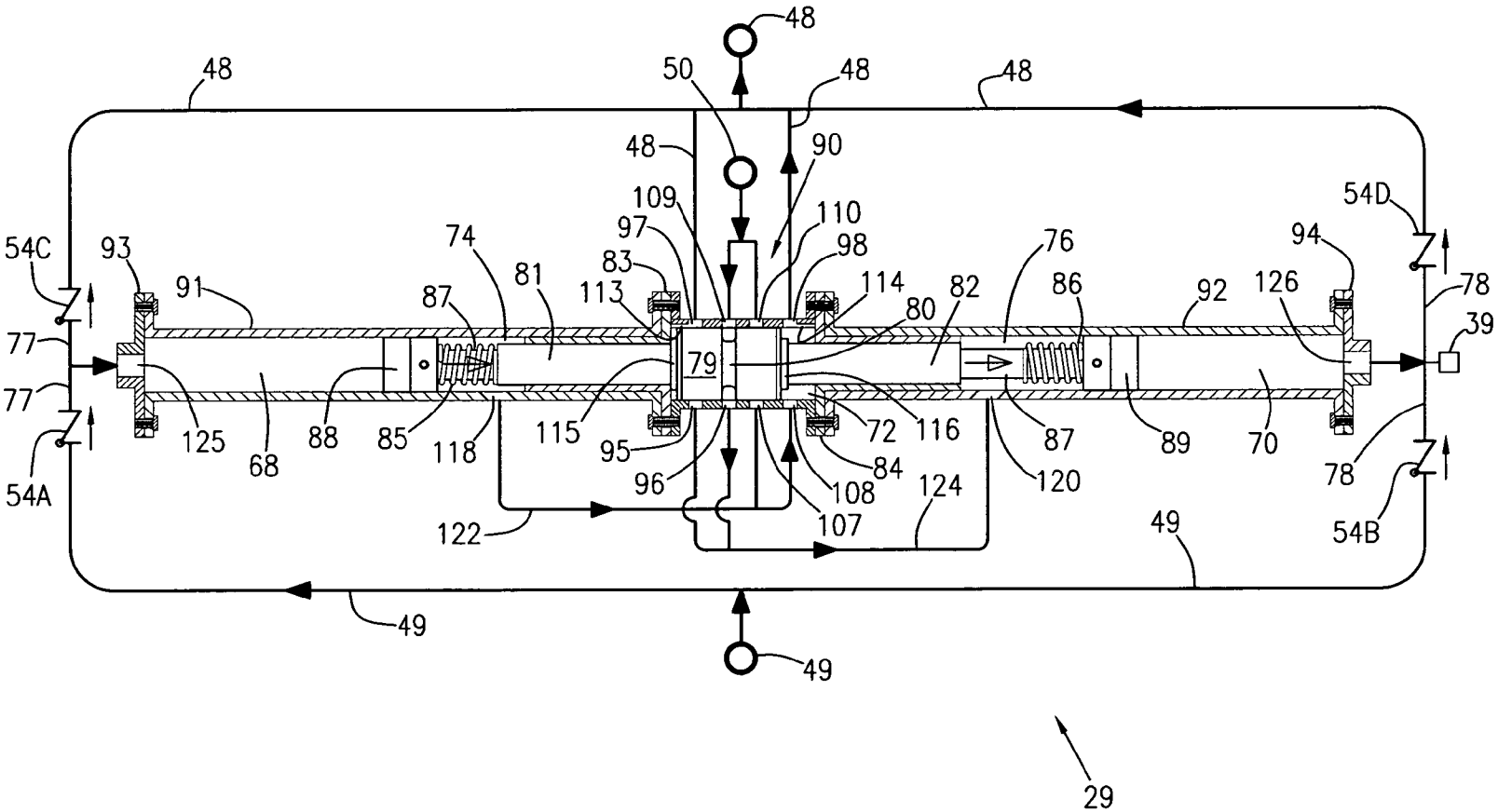
FIG. 14 is a simplified schematic of hydraulic pump 29 with surrounding piping in a first stage of a rightward stroke illustrating the flow of water throughout various components.

In the first stage, shown in FIG. 14, the spool apparatus is in a generally leftward position and the piston apparatus is in a generally rightward position, with compression spring 85 just coming into contact with valve bumper 81. Spool valve 79 is positioned so that ports 95, 107, and 110 are closed and that ports 96, 108 and 109 are all open to the middle chamber 72. Ports 97 and 98 can not be closed because channels 111 and 112, respectively, provide constant access to middle chamber 72 regardless of the position of spool valve 79. The channels 111 and 112 allow a free flow of water around spool valve 79 for facilitating an equal water pressure on both sides of the spool valve when the spool valve is in motion.

Water from the first reservoir is supplied to the pump from conduit 50. Water enters port 109, passes through spool valve channel 80 in spool valve 79, and enters pipeline 124 through port 96. The water travels via pipeline 124 into inner chamber 76 through right cylinder port 120. Right inner chamber 76 fills with the high pressure first reservoir water, pushing piston 89, and therefore the entire piston apparatus to the right, as indicated by the arrows superimposed over piston rod 87. As the piston apparatus shifts to the right, water from right end chamber 70 is pushed out port 126 into pipeline 78, which connects to outlet conduit 48. Check valves 54B and 54D allow the water to only travel in the direction indicated by the arrows in the schematic. Outlet conduit 48 deliver the water discharged from the pump to second reservoir 21.

Simultaneously, end chamber 68 fills with water supplied by pipeline 77 through port 125. Pipeline 77 also contains check valves 54A and 54C to ensure that water travels only in the direction indicated by the arrows in the schematic. The water from pipeline 77 is supplied by conduit 49 which is connected to third reservoir 22. Piston 88 pushes water from inner chamber 74 through left cylinder port 118 and into pipeline 122. Pipeline 122 delivers the water through port 108 into middle chamber 72 where it then exits through port 98 into outlet conduit 48.

Figure 15:
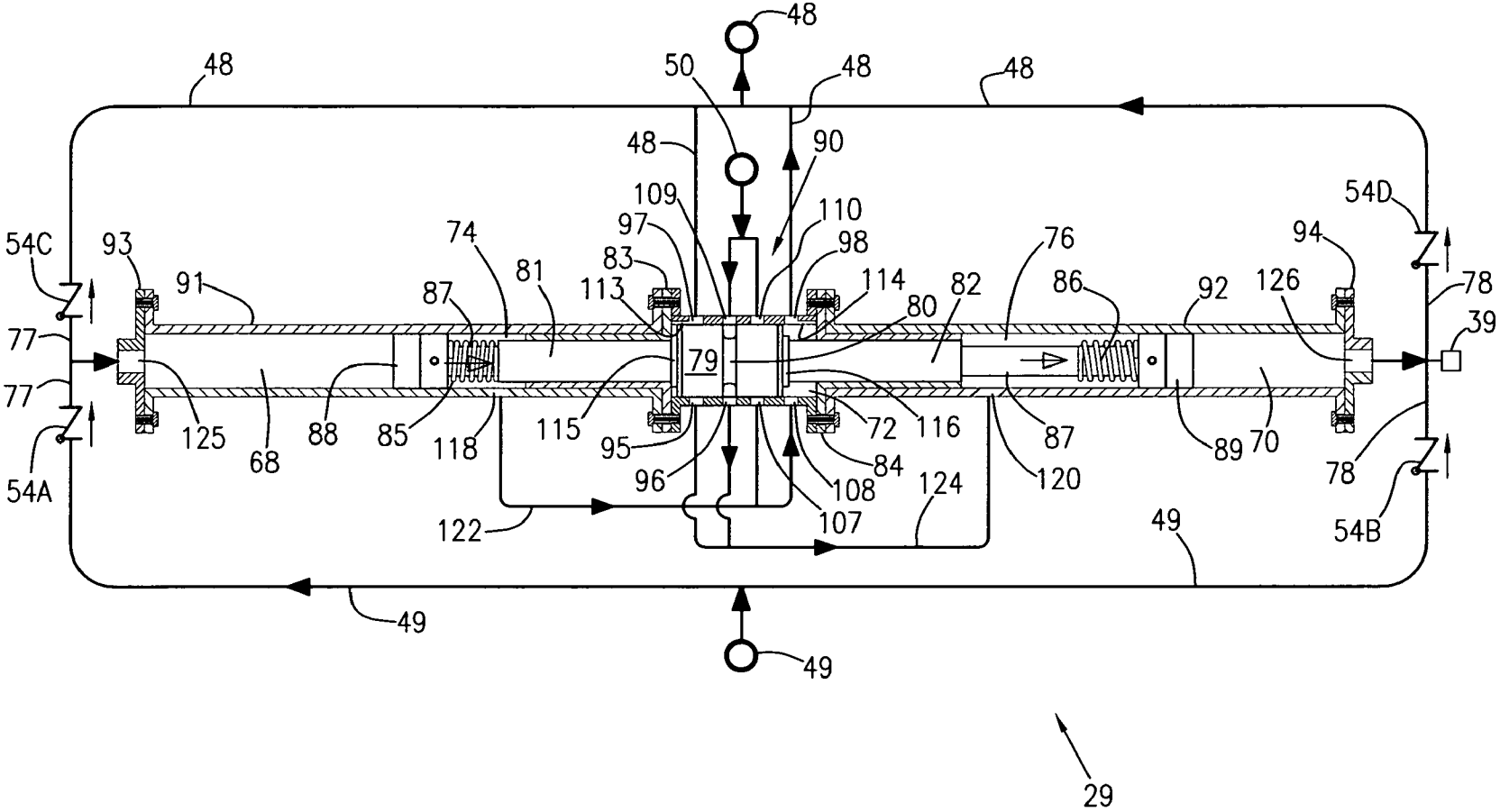
FIG. 15 is a simplified schematic of hydraulic pump 29 with surrounding piping in a second stage of a rightward stroke.

The second stage, as shown in FIG. 15, begins when compression spring 85 contacts valve bumper 81. During this stage water continues to travel as described for stage one. Throughout stage two spring 85 compresses because the piston apparatus is still being pushed to the right by the high pressure water. Once the spring is fully compressed the force on the piston apparatus will eventually overcome the force holding the valve assembly in place, and begin to push the valve assembly to the right.

It is important to note that the same pressure which is pushing piston 89 to the right is also pushing valve bumper 82 to the left. Therefore, the only way piston 88 would be able to move the valve apparatus would be if a higher net force were exerted on the piston than on the bumper. Since force is dependant on the surface area upon which the pressure is applied, the cylinder sleeves 83 and 84 act to lower the diameter of the valve apparatus, thus lowering the force on the valve apparatus by the water pressure. Also note that even if there is friction between the piston rod and the valve apparatus when the piston rod begins to move, the valve apparatus will initially remain in place because of the pressure acting on the valve bumpers.

Figure 16:
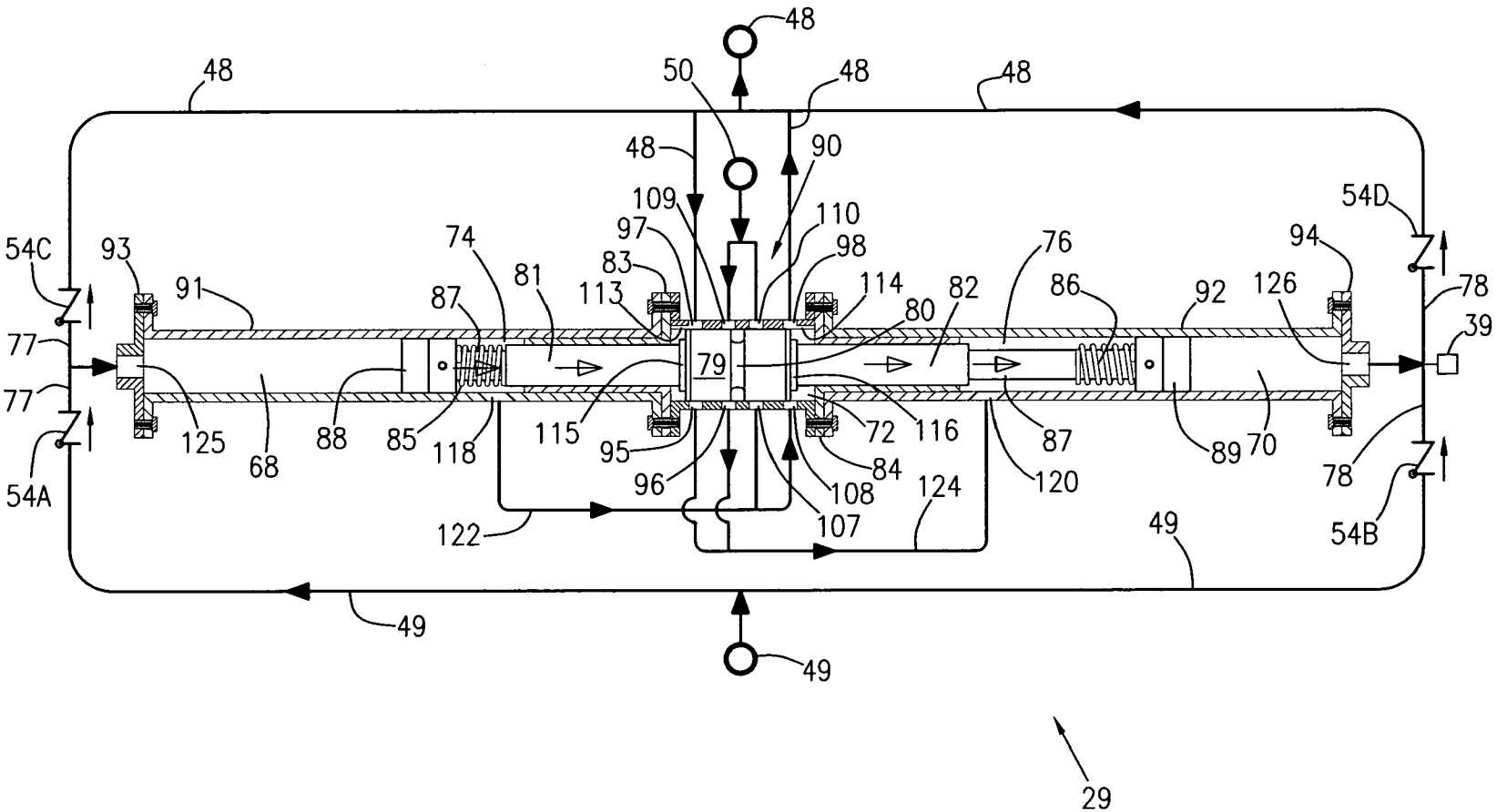
FIG. 16 is a simplified schematic of hydraulic pump 29 with surrounding piping in a third stage of a rightward stroke.

During stage three, shown in FIG. 16, the piston apparatus will push the valve apparatus to the right, as indicated by the arrows superimposed over valve bumpers 81 and 82, closing ports 96, 108, and 109. This is the start of the pump's reversing process, which is integrated automatically into each stroke due to the interaction of the spool valve on the ports in valve housing 90. Until ports 96, 108, and 109 are completely closed, the water will continue to flow as described for the previous two stages with the one exception that some water may exit port 98 and enter port 97 to evenly pressurize the middle chamber 72 on both sides of the spool valve 79. Also, although not shown in the simplified schematics, ports 105 and 106 which are connected by free flow pipeline 127 allow a constant free flow of water in middle chamber 72.

Figure 17:
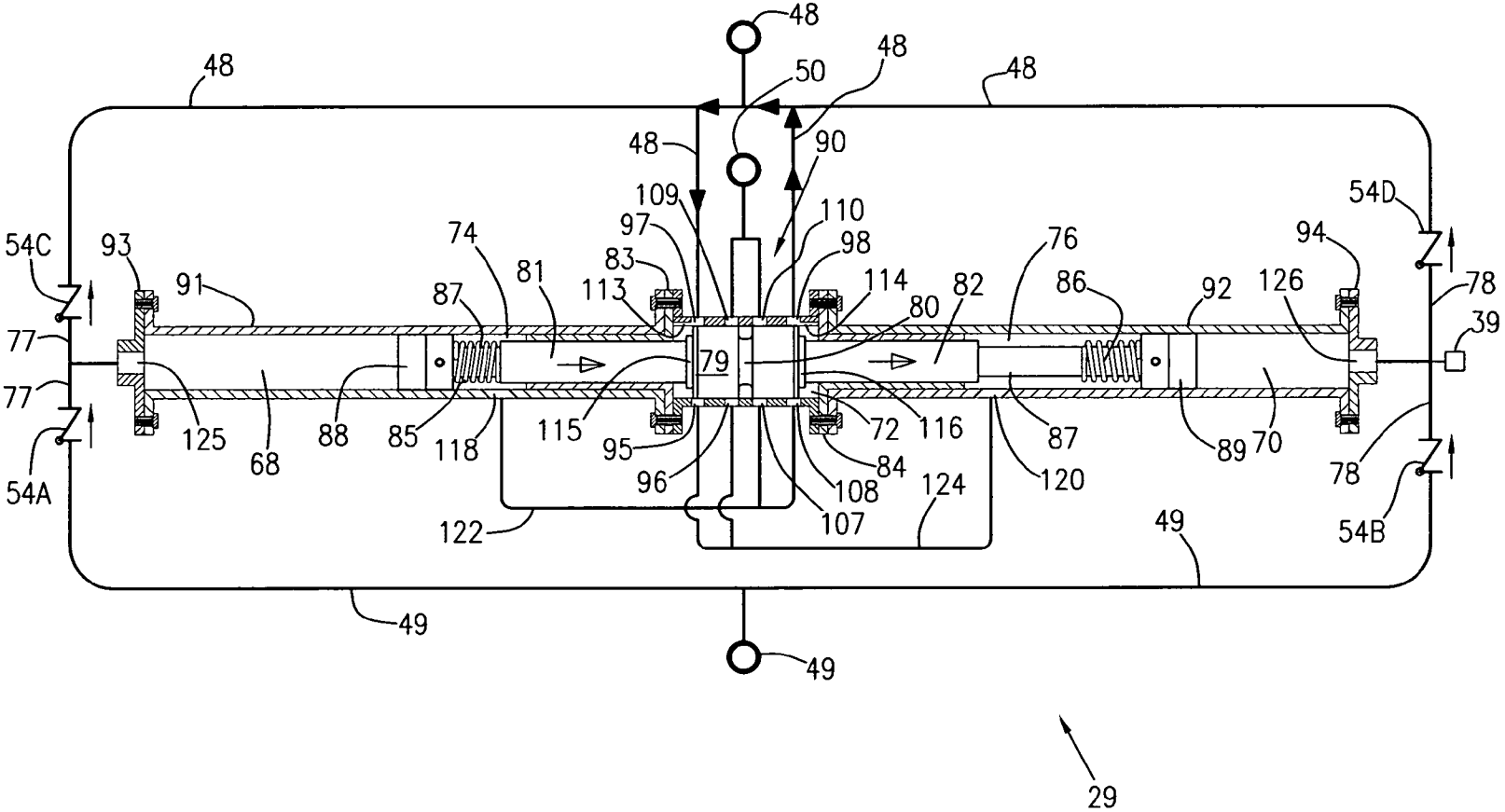
FIG. 17 is a simplified schematic of hydraulic pump 29 with surrounding piping in a fourth stage of a rightward stroke.

The fourth stage, illustrated in FIG. 17, begins when ports 96, 108, and 109 are closed. At this point ports 95, 107, and 110 are still closed as well. There is therefore essentially no water entering or exiting hydraulic pump 29 at this moment. The inertia in spool valve 79 along with the compressive force built up by spring 85 act to push the valve apparatus to the right. This opens a new set of ports, specifically ports 95, 107, and 110, thus completing the reversing of the pump, as now the water will begin to pull the piston apparatus back to the left side, where it originally started.

Figure 18:
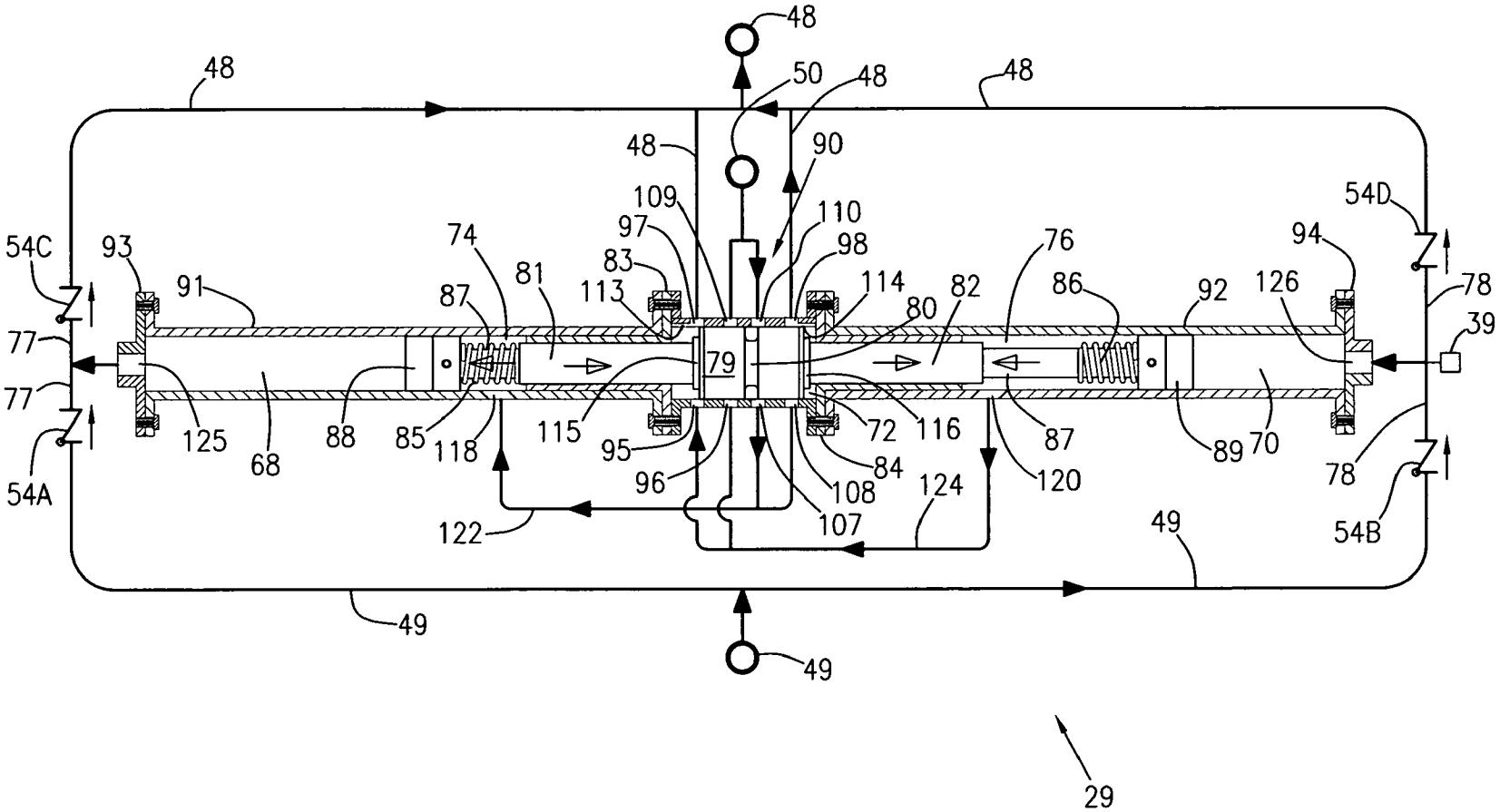
FIG. 18 is a simplified schematic of hydraulic pump 29 with surrounding piping in a fifth stage of a rightward stroke.

Stage five, depicted in FIG. 18, begins when ports 95, 107, and 110 begin to open. At this time as the valve apparatus is still shifting to the right, and water begins to enter port 110 from conduit 50 and flow through spool valve channel 80 and out of port 107 into pipeline 122. The water then flows into left inner chamber 74 which presses against piston 88 and begins to shift the piston apparatus back to the left. Water is therefore also beginning to be pushed out of right inner chamber 76 through port 120 and into pipeline 124, where it enters port 95, travels through middle chamber 72, exits port 97 into outlet conduit 48 which eventually deliver it to second reservoir 21. Water from third reservoir 22 travels via conduit 49 and pipeline 78 through port 126 to fill end chamber 70. At the same time, the water in end chamber 68 is pushed out port 125 into pipeline 77, where it travels to outlet conduit 48.

Figure 19:
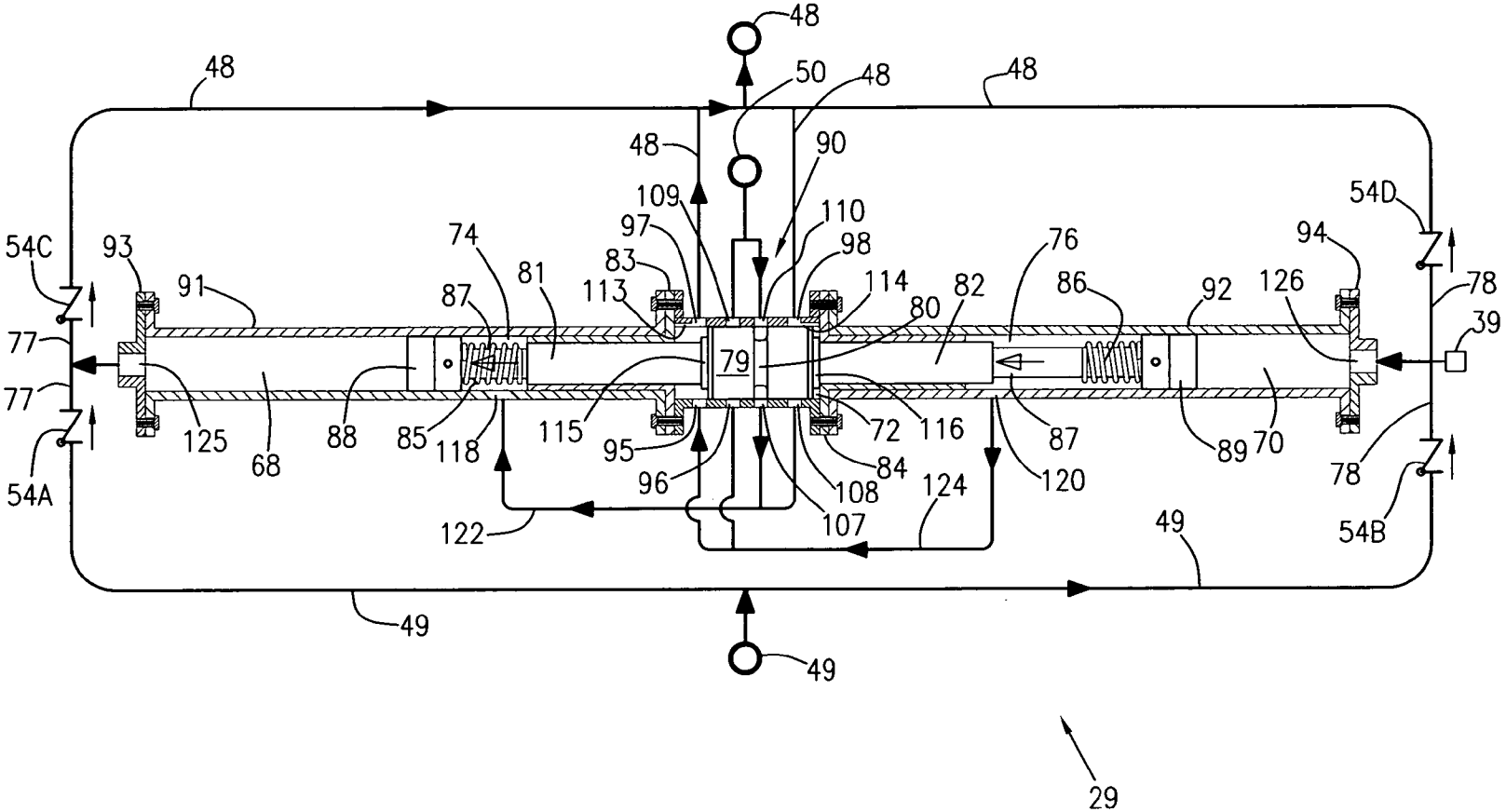
FIG. 19 is a simplified schematic of hydraulic pump 29 with surrounding piping in a sixth stage of a rightward stroke.
Figure 20:
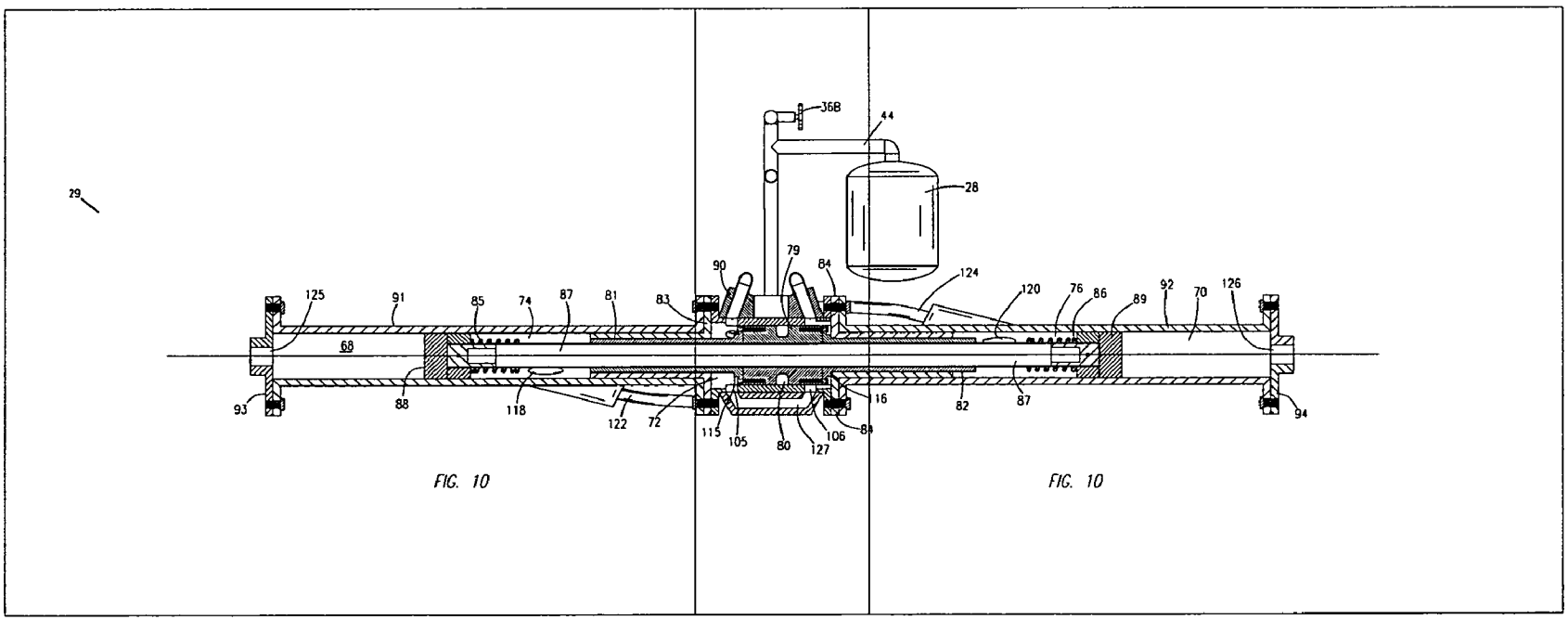
FIG. 20 is the two sheets of FIG. 10 arranged to fit on a single page.

FIG. 19 shows stage six in which ports 95, 107, and 110 become completely opened. At this stage spool valve 79 is resting in a fully rightward position in middle chamber 72. Water continues to flow as described with respect to FIG. 18.

At this point it should be appreciated that the pump is ideally symmetrical, so each stroke is essentially the mirror image of the stroke in the opposite direction. Therefore, if one were to view the pump from the opposite side, ignoring for the moment any reference numerals, the pump would appear to operate exactly as previous described with respect to FIGS. 14-19. For these reasons the process of the leftward stroke is readily determinable by envisioning the mirror image of the rightward stroke as described above. Additionally, Table 1 can be used to check which ports perform identical tasks, and therefore even the flow of water through the ports not shown in FIGS. 14-19 can readily be determined.

The most efficient way for hydraulic pump 29 to function is to be strictly on or off. Therefore, it may be desirable to have multiple hydraulic pumps 29 running at any given pump station in order to create the option of variable flow capability while pumping. When multiple pumps are running it may be advantageous to have them running out of phase with respect to each other. When the pumps go through the reversing step there is an increase of pressure within the system. If every pump reversed at the same time it may cause damaging pressure surges that could destroy the equipment.

Likewise, it may be desirable to have multiple water turbines 30 in embodiments such as hydraulic pumping system 12, in order to create the option of variable flow capability through the turbines. It may also be desirable to have multiple water filters 42 in order to have variable cleaning capability in filtering water. Using control valves 36A-36F in a throttling type manner may create high velocities at the control valve, turbulent flow, or an inefficient use of energy. Therefore, it may be desirable to also have the control valves operate strictly as either on or off. Slow, controlled opening and closing of the control valves is vital to avoiding harmful pressure surges which may damage the piping or other equipment.

It should be appreciated that additional reservoirs could be used, and that the above description which uses three reservoirs is just a preferred embodiment. In other embodiments the hydraulic pump might draw water from the third reservoir, while the second reservoir might discharge water down to a fourth reservoir. This might be the case where the source water to be pumped is dirty, has high turbidity, or is otherwise contaminated, and must be kept separate from the presumably clean first reservoir water or water that is filtered after leaving the second reservoir. Additionally, the water that leaves hydraulic pump 29 through either port 109 or 110 does not necessarily have to go to outlet conduit 48, but could instead go to the third reservoir, the end user, or any other location as needed.

Also, it should be clear to one in skilled the art that the hydraulic pump and hydraulic pumping system could be used to pump any liquid, not just water, as long as the pump was built of a material so as to resist any corrosive of destructive properties of the liquid being pumped.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What I claim is:

1. A system for hydraulically pumping liquid without using electricity comprising:

a first reservoir at a first elevation, operatively arranged to store a first liquid;

a second reservoir at a second elevation, where said second elevation is substantially lower than said first elevation, said second reservoir operatively arranged to store a second liquid;

a third reservoir at a third elevation, where said third elevation is substantially lower than said first elevation, said second elevation is higher than said third elevation, and said third reservoir operatively arranged to store said second liquid; and, at least one hydraulic pump connected to said first reservoir via a first conduit, connected to said second reservoir via a second conduit, connected to said third reservoir via a third conduit, said pump operatively arranged to be powered by said first liquid when said first liquid is permitted to fall due to gravity, and said pump operatively arranged to pump said second liquid from said third reservoir to said second reservoir.

2. The hydraulic pumping system recited in claim 1 wherein said system further comprises a liquid pressure surge protection means for maintaining a substantially constant liquid pressure.

3. The hydraulic pumping system recited in claim 2 wherein said liquid pressure surge protection means is an expansion tank, accumulator, or pressure sensitive valve.

4. The hydraulic pumping system recited in claim 1 wherein said system further comprises at least one turbine connected to a conduit running between said second reservoir and said third reservoir for generating electricity.

5. The hydraulic pumping system recited in claim 1 wherein said system further comprises at least one filter connected to a conduit running between said second reservoir and said third reservoir for cleaning the pumped liquid.

6. The hydraulic pumping system recited in claim 1 wherein said system further comprises a control valve for regulating the flow of liquid through said system.

7. The hydraulic pumping system recited in claim 6 wherein said control valve is manually operated.

8. The hydraulic pumping system recited in claim 6 wherein said control valve is remotely operated from a control station.

9. The hydraulic pumping system recited in claim 1 wherein said system further comprises a sand trap connected to said first conduit for removing debris from said first liquid.

10. The hydraulic pumping system recited in claim 1 wherein said system further comprises at least one depth probe to monitor the depth of said first reservoir, said second reservoir, or said third reservoir.

11. The hydraulic pumping system recited in claim 1 wherein said second reservoir contains a conduit for delivering the liquid stored in said second reservoir out of said system.

12. The hydraulic pumping system recited in claim 1 wherein said third reservoir contains a conduit for delivering the liquid stored in said third reservoir out of said system.

13. The hydraulic pumping system recited in claim 1 wherein said system further comprises a plurality of check valves for ensuring the flow of liquid in only the desired directions.

14. A system for hydraulically pumping liquid without using electricity comprising:

a first reservoir at a first elevation, operatively arranged to store a first liquid;

a second reservoir at a second elevation, where said second elevation is substantially lower than said first elevation, said second reservoir operatively arranged to store a second liquid;

a third reservoir at a third elevation, where said third elevation is substantially lower than said first elevation, said second elevation is higher than said third elevation, and said third reservoir operatively arranged to store a third liquid; and, at least one hydraulic pump connected to said first reservoir via a first conduit, connected to said second reservoir via a second conduit, connected to said third reservoir via a third conduit, said pump operatively arranged to be powered by said first liquid when said first liquid is permitted to fall due to gravity, said pump operatively arranged to discharge said first liquid into said third liquid, wherein said discharged first liquid and said third liquid combine to form said second liquid, and said pump operatively arranged to pump said second liquid from said third conduit to said second reservoir.

* * * * *

UNITED STATES PATENT AND TRADEMARK OFFICE

CERTIFICATE OF CORRECTION

PATENT NO. : 7,740,455 B1
APPLICATION NO. : 11/825700
DATED : June 22, 2010
INVENTOR(S) : Brian Nissen It is certified that error appears in the above-identified patent and that said Letters Patent is hereby corrected as shown below:

IN THE SPECIFICATIONS:

In column 7, line 32, "Power in = Flow rising" should read "Power out = Flow rising"

Signed and Sealed this
Twenty-first Day of January, 2014

Michelle K. Lee

Michelle K. Lee
*Deputy Director of the United States Patent and Trademark Office*